US007871076B2

(12) United States Patent
Yuzawa et al.

(10) Patent No.: US 7,871,076 B2
(45) Date of Patent: Jan. 18, 2011

(54) SHEET CONVEYING APPARATUS AND IMAGE FORMING APPARATUS

(75) Inventors: Atsuyuki Yuzawa, Susono (JP); Wataru Uchida, Mishima (JP); Takeshi Horioka, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 119 days.

(21) Appl. No.: 11/873,023

(22) Filed: Oct. 16, 2007

(65) Prior Publication Data

US 2008/0179823 A1 Jul. 31, 2008

(30) Foreign Application Priority Data

Oct. 23, 2006 (JP) ..... 2006-287385
Oct. 5, 2007 (JP) ..... 2007-261463

(51) Int. Cl.
*B65H 39/10* (2006.01)

(52) U.S. Cl. ..... 271/303

(58) Field of Classification Search ..... 271/225, 271/303, 184, 185, 162; 399/124, 21
See application file for complete search history.

(56) References Cited

U.S. PATENT DOCUMENTS 5,237,381 A * 8/1993 Hamada ..... 399/406
6,332,611 B1 12/2001 Tomita

FOREIGN PATENT DOCUMENTS

JP 4-23763 * 1/1992
JP 4-246055 9/1992
JP 2001-039602 2/2001

* cited by examiner

*Primary Examiner*—Stefanos Karmis
*Assistant Examiner*—Thomas A Morrison
(74) *Attorney, Agent, or Firm*—Fitzpatrick, Cella, Harper & Scinto

(57) ABSTRACT

A sheet conveying apparatus having an excellent performance in jam recovery, and an image forming apparatus provided therewith is provided. The sheet conveying apparatus which may switch the conveying direction of a sheet has: a discharge switching member 60; and a moving unit including a rod 64 and a solenoid 63, which engage with the discharge switching member 60 and moves the discharge switching member 60, in order to switch the conveying direction of a sheet. The discharge switching member 60 and the moving unit may disengage from each other.

12 Claims, 14 Drawing Sheets

(DOUBLE-SIDED CONVEYING GUIDE MODE)

(JAM RECOVERY MODE)

(JAM RECOVERY MODE)

(DISCHARGE GUIDE MODE)

(DOUBLE-SIDED CONVEYING GUIDE MODE)

(DISCHARGE GUIDE MODE)

(DOUBLE-SIDED CONVEYING GUIDE MODE)

(JAM RECOVERY MODE)

(JAM RECOVERY MODE)

SHEET CONVEYING APPARATUS AND IMAGE FORMING APPARATUS

BACKGROUND OF THE INVENTION

1. Field of the Invention

The present invention relates to a sheet conveying apparatus which may switch a sheet conveyance path in an image forming apparatus such as a copying machine, a printer, and facsimile terminal equipment, and to an image forming apparatus using the sheet conveying apparatus.

2. Description of the Related Art

Recently, an image forming apparatus such as an electrophotographic device has realized high-speed processing, colorization, as well as reduction in size.

In an image forming apparatus such as a copying machine, a printer, and facsimile terminal equipment, there has been sometimes used a sheet-conveyance-path switching mechanism for switching a conveyance path on which a sheet is conveyed. One example is an image forming apparatus that can perform recording on both sides of a sheet. Usually, a switching mechanism actuates a separation claw or a branch board (the separation claw or the branch board may also function as a conveying guide and generically called "conveying-guide switching member" hereinafter) for switching the conveyance path, using an actuator such as solenoid.

However, a conventional sheet-conveyance-path switching device has actuated a conveying-guide switching member, using an actuator such as a solenoid, for switching operation of a switching mechanism to switch a conveyance path. Accordingly, as there is not a driving region large enough for the conveying guide switching member, it has not been easy to remove jammed paper in an inner portion of the conveying guide switching member, when the conveying guide switching member is mounted in a main body of an image forming apparatus.

Then, there has been proposed a conveyance-path switching mechanism (Japanese Patent Application Laid-Open (JP-A) No. 2001-039602) in which, as shown in FIG. 7, a conveying guide switching member 101 and a support material 102 are opened as one body in cooperation with a opening-and-closing cover 100 when the opening-and-closing cover 100 is opened. According to this mechanism, when the opening-and-closing cover 100 is opened, the conveying guide switching member 101 goes away from jammed paper, and a paper sheet conveyance branch portion is widely opened for easy removal of jammed paper.

However, in a configuration according to JP-A No. 2001-039602, a space for jam recovery is secured by rotating the conveyance-path switching mechanism in its entirety, rather than one component of the conveying guide switching member. Therefore, a complex link mechanism is required and a larger rotational locus of the opening-and-closing cover 100 is caused to require a larger space.

Moreover, in the configuration of JP-A No. 2001-039602, when jammed paper is generated on both front side and back side in the conveying guide switching member, an opening-and-closing guide is closed after the jammed paper on the front side is removed first, and the opening-and-closing guide is required to be opened again in order to remove the jammed paper on the back side.

The present invention has been made, considering the above-described problem, and it is an object of the present invention to provide a sheet conveying apparatus, which has an excellent performance in jam recovery, and an image forming apparatus provided therewith.

SUMMARY OF THE INVENTION

In order to solve the above-described problem, a typical apparatus according to the present invention is a sheet conveying apparatus which can switch a conveying direction of a sheet, comprising: a switching member which switches the conveying direction of the sheet; a holding member which holds the switching member at a first position for guiding the sheet in a first conveying direction; an biasing member which applies a force on the switching member onto the holding member; and a moving unit which moves the switching member from the first position to a second position for guiding the sheet in a second conveying direction against the force applied by the biasing member, wherein the switching member disengages from the moving unit by releasing holding the switching member at the first position through the holding member, and can be moved to a third position for jam recovery.

According to the present invention, the switching member and the moving unit may be disengaged from each other when the switching member is moved, and thus an opening angle of the switching member may be increased without restriction by the moving unit. Accordingly, there may be realized a sheet conveying apparatus having a conveyance-path switching mechanism which has an excellent performance in jam recovery.

DESCRIPTION OF THE EMBODIMENTS

Then, a sheet conveying apparatus according to one embodiment of the present invention will be described, referring to an image forming apparatus provided therewith.

First Embodiment

Entire Configuration of Image Forming Apparatus

Figure 1:
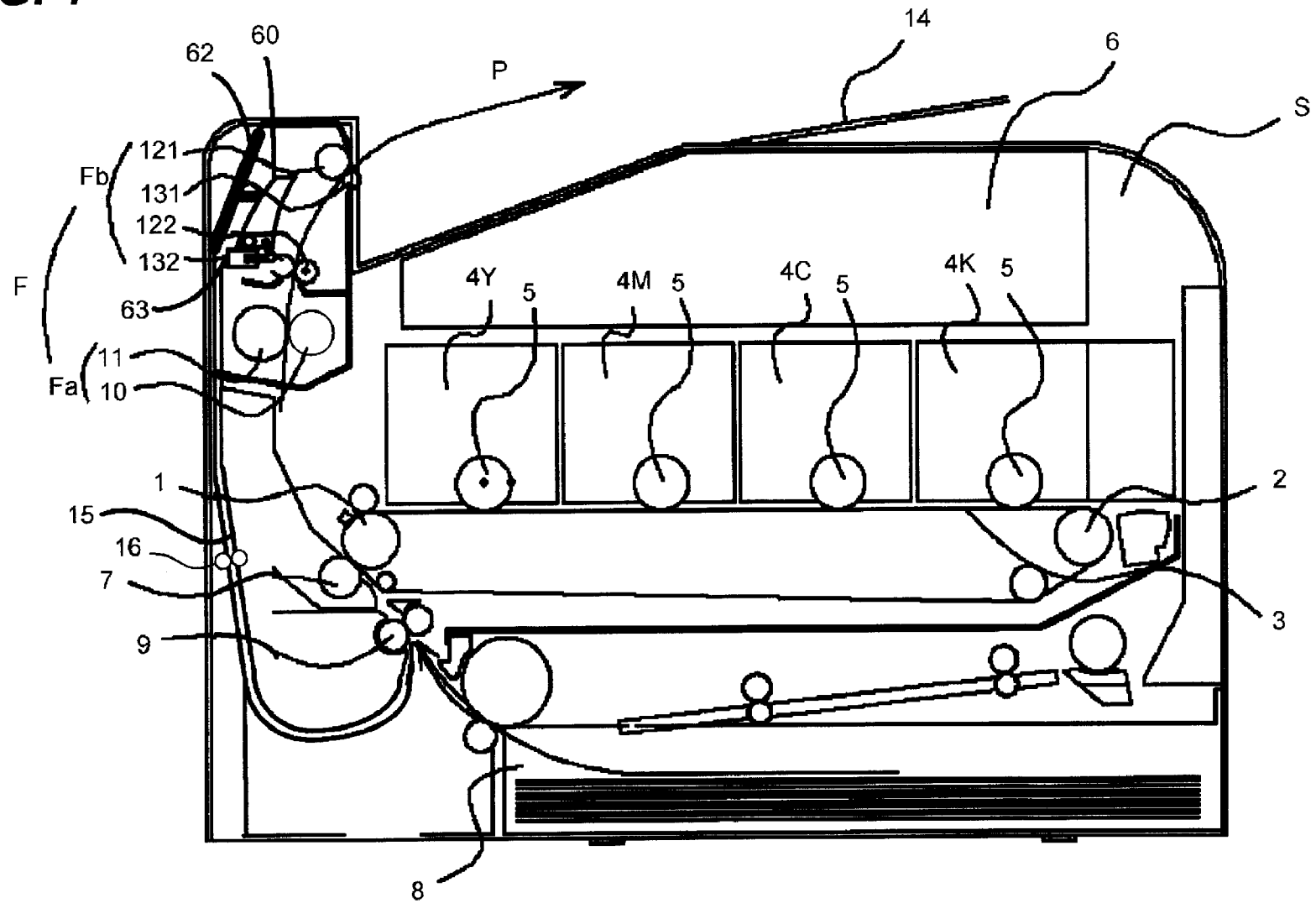
FIG. 1 is a schematic sectional view illustrating an image forming apparatus.

FIG. 1 is a schematic sectional view of an image forming apparatus according to a first embodiment. First, an entire configuration of an image forming apparatus will be described together with image forming operation referring to FIG. 1.

In a main body S of the image forming apparatus, image forming units 4 (4M, 4C, 4Y, and 4K) for Magenta (M), Cyan (C), Yellow (Y), black (K) are laterally arranged in one row on the peripheral surface of an intermediate transfer belt 3 stretched and suspended around a driving roller 1 and a tension roller 2. A latent image is formed on the surface of a photosensitive drum 5 in each image forming unit 4 by light irradiation according to a image signal from an exposure unit 6, and toner developing of the latent image is performed by a not shown development device. Subsequently, there is performed primary transfer of toner images of each color on the photosensitive drums onto the intermediate transfer belt 3 in a transfer portion opposing to the photosensitive drum 5, and then the transferred images are conveyed into a secondary transfer portion formed with a nip portion with a transfer roller 7.

In synchronization with the image forming operation, a sheet P is fed from a sheet cassette 8, and is led to the secondary transfer portion through a conveyance roller 9 for secondary transfer of the toner image on the intermediate transfer belt 3 onto the sheet P by applying a bias to the transfer roller 7.

The sheet P into which the toner image is transferred is conveyed to a fixing device F. A fixing portion Fa and a discharge portion Fb are provided as one body in the fixing device F. The fixing portion Fa has a fixing roller 10 provided with a heating unit, and a pressure roller 11 abutting thereon. The discharge portion Fb has a discharge roller pair 121 and 131 provided at the exit of the fixing device F and a leveling roller pair 122 and 132 provided in the downstream of the fixing portion Fa.

The discharge roller pair 121 and 131 are divided and arranged in the longitudinal direction (the sheet width direction orthogonal to the sheet conveying direction). On the other hand, the leveling roller pair 122 and 132 has an almost equal width in the longitudinal direction to the width of the sheet, and is pressed onto and is contacted with the toner image after fixing for smoothing, in a region in which toners heated after fixing are soft.

While the sheet P is conveyed, being nipped by a fixing nip portion N between the fixing roller 10 and the pressure roller 11, the sheet P is heated and pressurized to fix the toner image. The sheet P having the toner image fixed in the fixing portion Fa is led to the outside of the fixing device F by the discharge portion Fb, and is finally stacked on a discharge tray 14. At double-sided printing, after being re-fed by a switchback mechanism from a state that the rear end of the sheet which is printed whith image on one side is nipped by the discharge roller pair 121 and 131, the sheet P is led to the conveyance roller 9 again by a double-sided conveying guide 15 and the conveyance roller 16. Then the sheet is led to the secondary transfer portion by the conveyance roller 9 for secondary transfer of the toner image on the intermediate transfer belt 3 onto the sheet P by applying a bias to the transfer roller 7.

[Sheet Conveying Apparatus]

A discharge switching member (switching member) 60 as a conveying guide switching member is provided in the sheet conveying apparatus forming the discharge portion Fb in the fixing device F, and the conveying direction of a sheet to be conveyed may be switched by the member 60. Subsequently, the sheet conveying apparatus will be described.

After fixing the sheet P, the discharge switching member 60 according to the first embodiment is used as: (1) a discharge guide; (2) a sheet-side-reversing switching member for the sheet P; and (3) a door for jam recovery which is required at single-sided printing.

Figure 2:
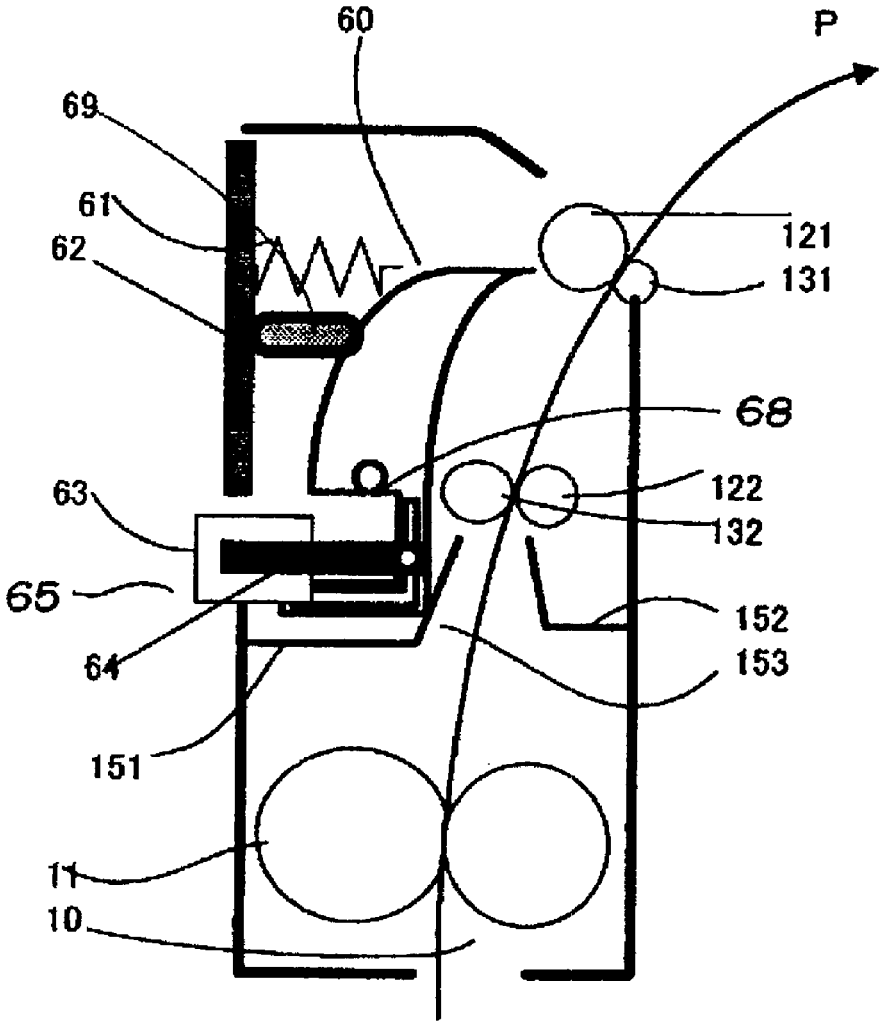
FIG. 2 is a schematic view illustrating a sheet conveying apparatus according to a first embodiment.

The discharge portion Fb according to the first embodiment includes, as shown in FIG. 2, the discharge roller pair 121 and 131; the leveling roller pair 122 and 132; the discharge switching member 60; an elastic member 61; a moving unit 65; and a abutting member 69.

The discharge switching member 60 switching the conveying direction of the sheet is mounted in the fixing device F in such a way that the member 60 may be rotated around a center 68 of rotation. Moreover, the discharge switching member 60 is always applied a force in the direction of the arrow A (FIG. 3A by the elastic member 61 composed of an extension spring, and, when a rear door 62, also serving as an exterior cover of the sheet conveying apparatus, is closed, the member 60 hits an abutting member 69 which is provided on the rear door 62 and to serve as a holding member, to decide the position of the member 60. Here, the rear door 62 may also serve as the exterior of the sheet conveying apparatus, or an exterior of the sheet conveying apparatus may be separately provided. When the rear door 62 is opened, the discharge switching member 60 is not held by the abutting member 69 of the rear door 62, and is opened in the opening direction of the rear door 62 by the elastic member 61.

The moving unit 65 is engaged with the discharge switching member 60 for rotation thereof, and includes a rod 64 (actuating member) engaging with the discharge switching member and a solenoid (driving member) 63 for actuating the rod 64 while engaging therewith. The rod 64 engaged with the discharge switching member 60 is operated in the right and left direction of FIG. 3A through FIG. 3C by turning on and off of the solenoid 63. Thereby, the discharge switching member 60 may be rotated around the center 68 of rotation.

Figure 3A:
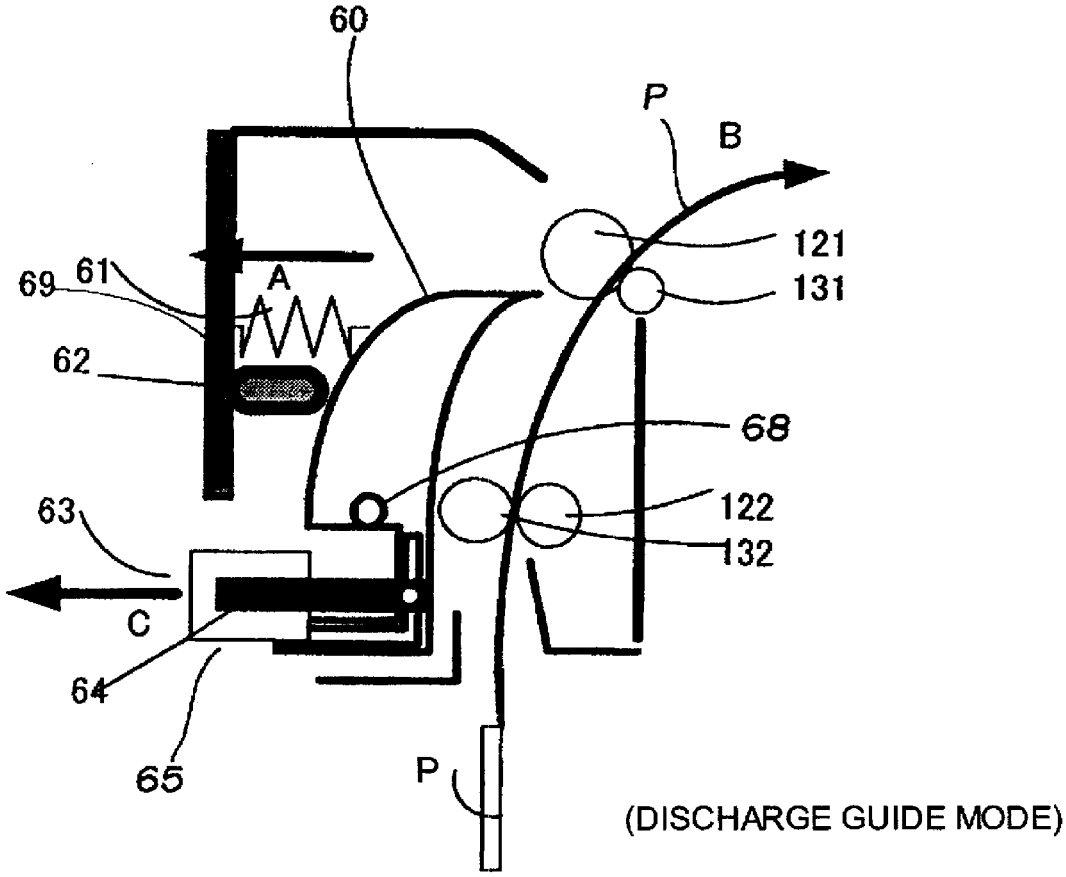
FIG. 3A is a view illustrating a discharge guide mode according to the first embodiment.

Moreover, the rod 64 is configured engageable and disengageable, that is, the rod 64 may be engaged with, or disengaged from the solenoid 63. When the rod 64 is engaged with the solenoid 63, the solenoid 63 is turned on and the rod 64 is drawn in the direction of the arrow C (FIG. 3A). On the other hand, the rod 64 is not restricted by the solenoid 63 and is freely slidable while the rod 64 is disengaged with the solenoid 63, because it is impossible to control the rod 64 by the solenoid 63. Here, the rod 64 is configured not to drop off from the solenoid 63 even when the rod 64 is disengaged from the solenoid 63 and is freely slidable.

Figure 3B:
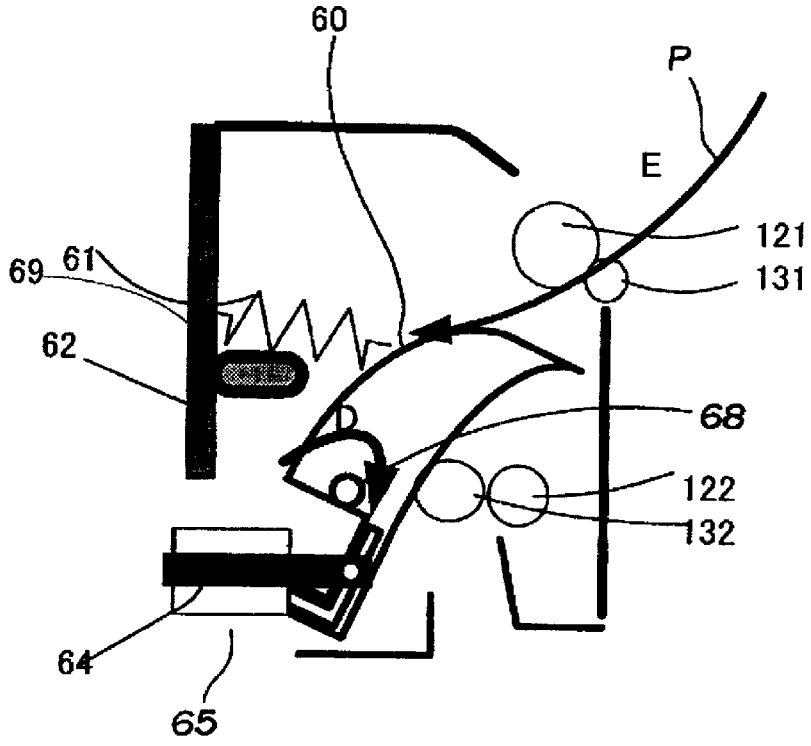
FIG. 3B is a view illustrating a double-sided conveying guide mode according to the first embodiment.

The discharge switching member 60 is moved to three positions corresponding to the discharge guide mode shown in FIG. 3A, the double-sided conveying guide mode shown in FIG. 3B, and the jam recovery mode shown in FIG. C, respectively, and realizes different functions according to each of holding angles. Here, the three modes of functions of the discharge switching member 60 will be described, referring to FIG. 3A through FIG. 3B.

In the state of the discharge guide mode shown in FIG. 3A, the discharge switching member 60 forms a conveying guide between the discharge roller pair 121 and 131, and the leveling roller pair 122 and 132. As the rear door 62 is closed, the discharge switching member 60 is in a region in which the discharge switching member 60 may be rotated by switching between the on-state and the off-state of the solenoid 63. At this time, the solenoid 63 is in the off-state, and the discharge switching member 60 itself is applied a force by the elastic member 61 as an biasing member and is at the first position positioned by the abutting member 69 of the rear door 62 as the holding member. That is, the discharge switching member 60 functions as a guide by which the sheet P is conveyed in the direction of the arrow B (first direction).

In order to shift to the double-sided conveying guide mode shown in FIG. 3B, the rod 64 is drawn from the position of the state shown in FIG. 3A in the direction of the arrow C (FIG. 3A) by turning on the solenoid 63 to rotate the discharge switching member 60 in the direction of the arrow D (FIG. 3B) against the force applied by the elastic member 61. Therefore, the discharge switching member 60 is moved to a second position in such a way that the sheet P is led from the first position in the direction of the arrow E (a second direction), and is put into the state of FIG. 3B for the double-sided conveying guide mode.

At double-sided printing, the state of FIG. 3B is obtained by turning on the solenoid 63 when the rear end of the sheet P goes beyond the tip of the discharge switching member 60 in the state of FIG. 3A. Then, the sheet P is switchbacked in the direction of the arrow E (FIG. 3B) by reversing the discharge roller pair 121 and 131, and passes through a surface opposite to the discharge guide of the discharge switching member 60. Thus, the discharge switching member 60 functions as a sheet-conveying-path switching member at double-sided printing and the conveying guide of the sheet P at double-sided printing.

After the sheet P has passed, the discharge switching member 60 is applied a force by the elastic member 61 again to return to the discharge guide mode shown in FIG. 3A because attraction force of the rod in the direction of the arrow C is eliminated by turning off the solenoid 63 in the state shown in FIG. 3B.

Figure 3C:
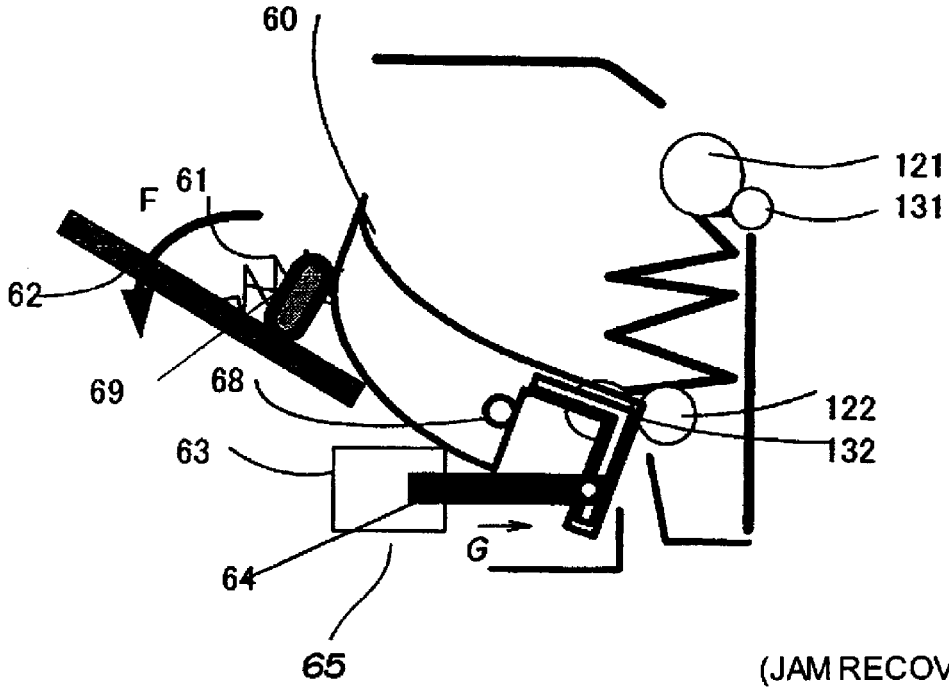
FIG. 3C is a view illustrating a jam recovery mode according to the first embodiment.
Figure 4:
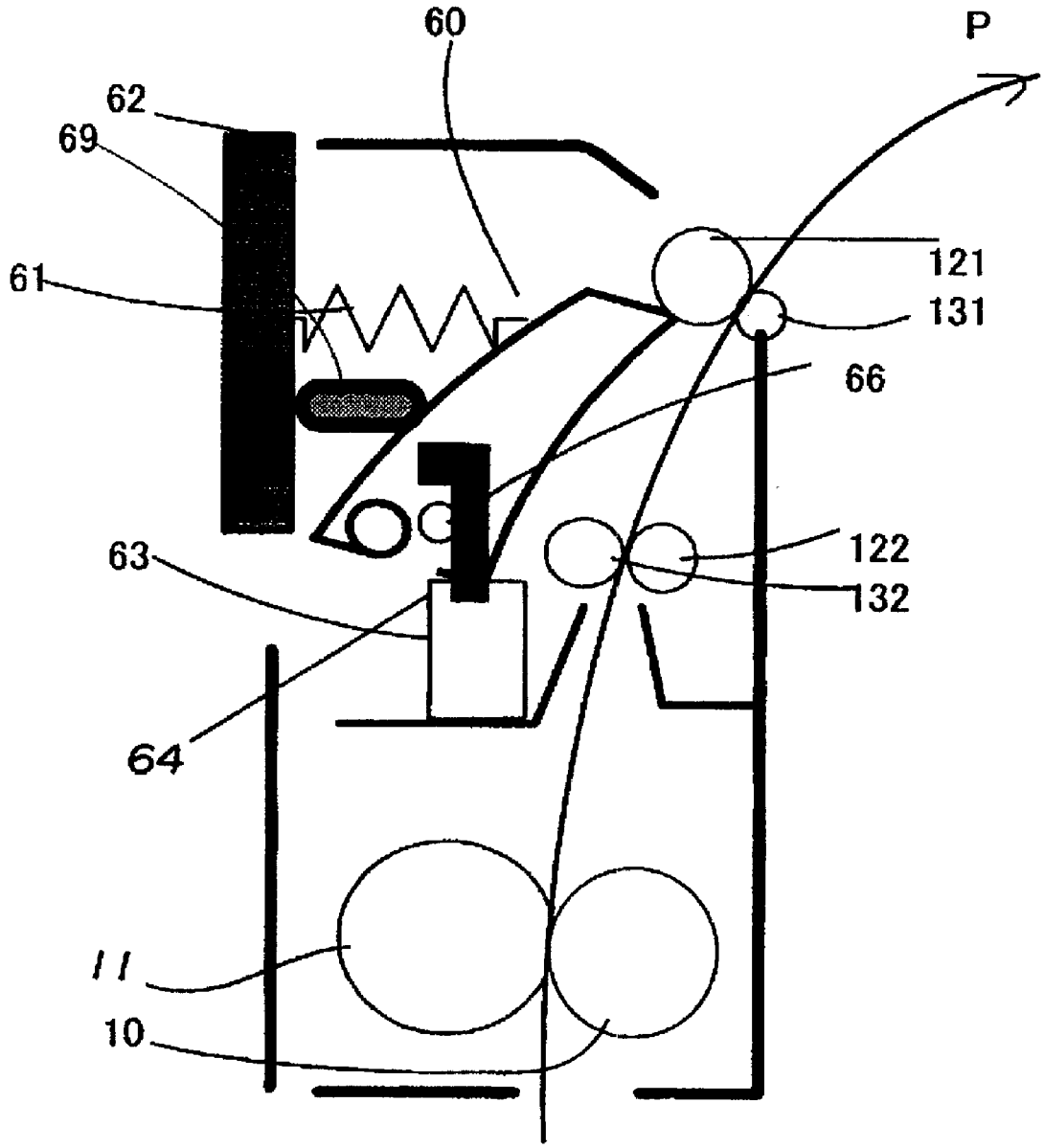
FIG. 4 is a schematic view illustrating a sheet conveying apparatus according to a second embodiment.

The discharge switching member 60 opens the door 62 to change the sheet guide position shown in FIG. 3A to that of the jam recovery mode shown in FIG. 3C. Therefore, holding at the first position of the discharge switching member 60 is released by losing support by the abutting member 69 of the rear door 62, and the discharge switching member 60 is rotated in the direction of the arrow F by the force of the elastic member 61 to open the rear door 62. At this time, the rod 64 of the solenoid 63 is pulled out in the direction of the arrow G along with the movement of the discharge switching member 60. If the discharge switching member 60 is moved by more than a predetermined amount when the rod 64 is pulled out, the rod 64 is pulled out to a region, in which the solenoid 63 may not drive, and the rod 64 is disengaged from the solenoid and may freely slide. It secures a space for the discharge switching member 60 to be rotated by a larger angle in the direction of the arrow F at a third position of the jam recovery.

When the rear door 62 is closed after the jam recovery, the discharge switching member 60 is also closed by being pressed by the abutting member 69. The rod 64 is slid by movement of the discharge switching member 60 at this time in such a way that the rod 64 is pressed into the solenoid 63, and is moved to a region again in which the solenoid 63 may drive so as to return to a state that the rod 14 is engaged with the solenoid 63.

As described above, improved jam recovery may be obtained because the opening angle of the discharge switching member 60 may be increased at jam recovery by releasing the discharge switching member 60 from restriction by the solenoid 63.

Though the solenoid 63 has been used as an actuator for driving the discharge switching member 60 in the first embodiment, similar advantages may be obtained also by using, for example, a rack which moves vertically by a driving source, instead of the solenoid 63.

Though the discharge switching member 60 provided in the fixing device as one body has been illustrated as a conveying guide switching member in the first embodiment, the above-described configuration of the conveyance-path switching mechanism may be applied in other units. The switching member is not limited to a member to switch by rotating, and the switching member can be a member to switch by shifting.

Second Embodiment

Then, a apparatus according to a second embodiment will be described, referring to FIG. 4 and FIGS. 5A through 5C. Here, repeated explanations will be eliminated and only a configuration featuring the second embodiment will be described, since a basic configuration of the apparatus according to the second embodiment is the same as that of the above-described embodiment. Members having similar functions to those of the previously described embodiment will be denoted by the same reference numbers as those in the first embodiment.

The second embodiment differs from the first embodiment in a discharge switching member 60 and a solenoid 63. In the first embodiment, the discharge switching member 60 has been engaged with the rod 64 of the solenoid 63 at any moment. Therefore, when the rear door 62 is opened, the discharge switching member 60 has lost support by the abutting member 69, and the rear door 62 has been opened in the opening direction by the elastic member 61 in the jam recovery mode as shown in FIG. 3C. At this moment, the rod 64 of the solenoid 63 has moved to a region in which the solenoid 63 may not drive.

In the second embodiment, the discharge switching member 60 and a rod 64 of the solenoid 63 are engaged with each other only when a rear door 62 is closed. That is, the discharge switching member 60 and the rod 64 are disengageably configured at a jam recovery mode, though the member 60 and the rod 64 are engaged with each other at the discharge guide mode and the double-sided conveying guide mode. Accordingly, the rod 64 is always located in a region in which the solenoid 63 may drive.

Moreover, when the rear door 62 is closed, an arm extending from the discharge switching member 60 moves to a position that the arm is engaged with the solenoid 63, and the discharge switching member 60 is driven by switching between the on-state and the off-state of the solenoid 63.

Operations by the discharge switching member 60, the solenoid 63, and the rod 64 according to the second embodiment will be described, referring to FIGS. 5A through 5C.

Figure 5A:
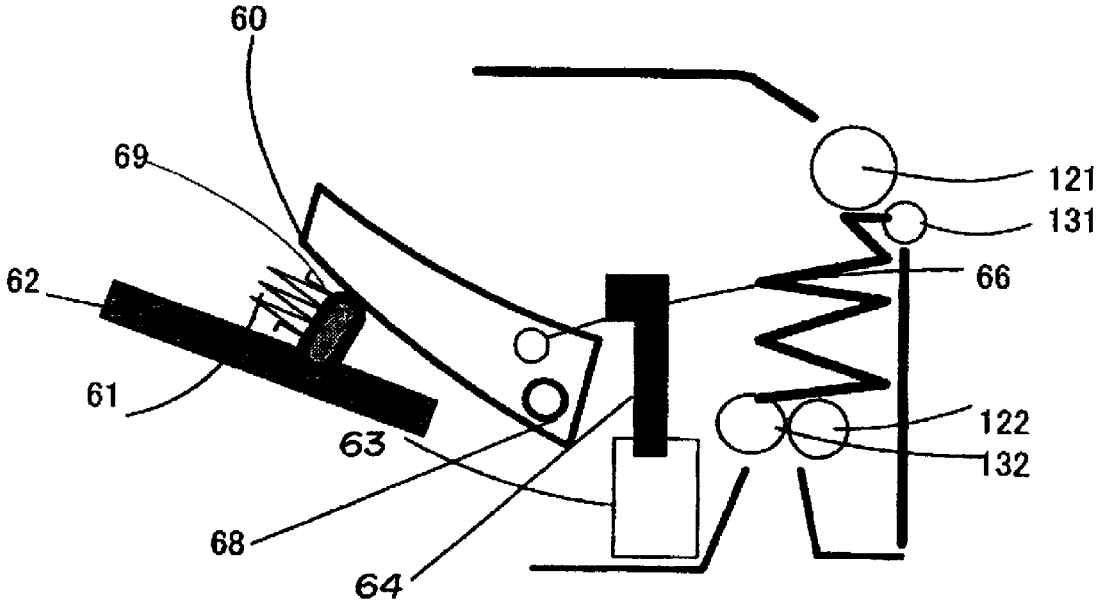
FIG. 5A is a view illustrating a jam recovery mode according to the second embodiment.
Figure 5B:
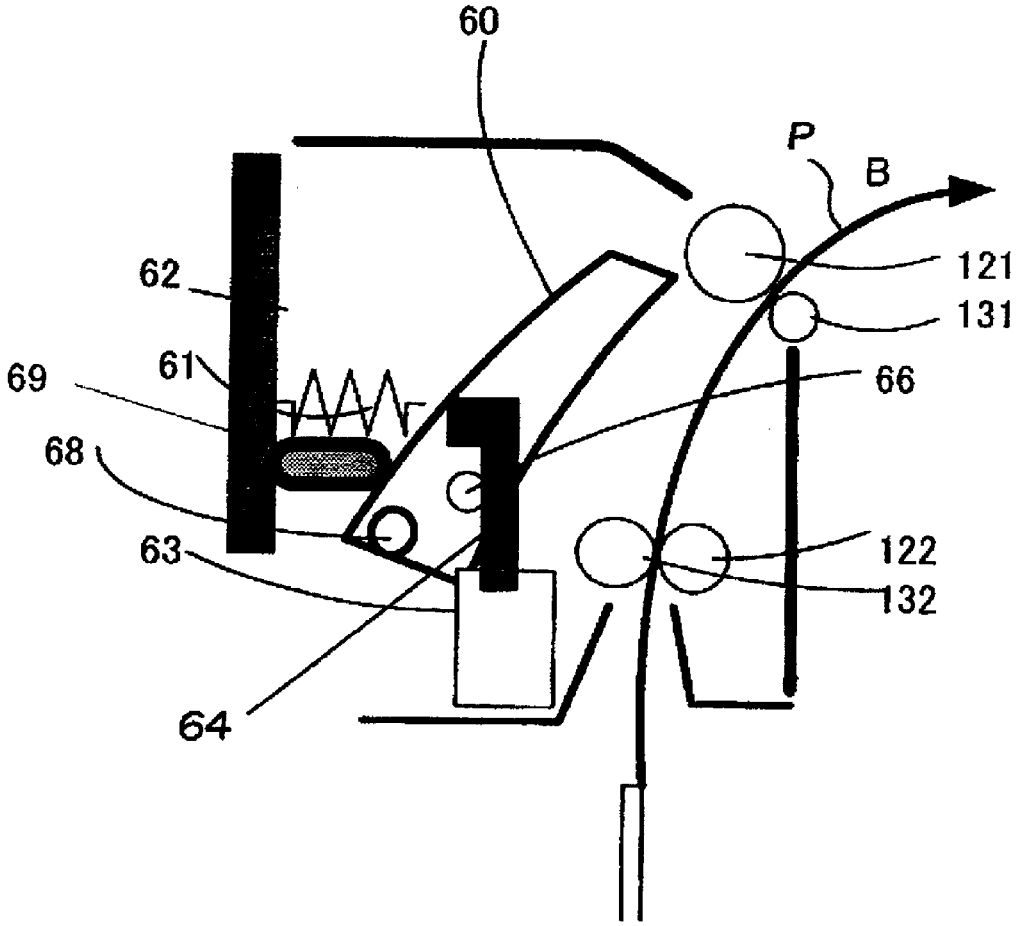
FIG. 5B is a view illustrating a discharge guide mode according to the second embodiment.
Figure 5C:
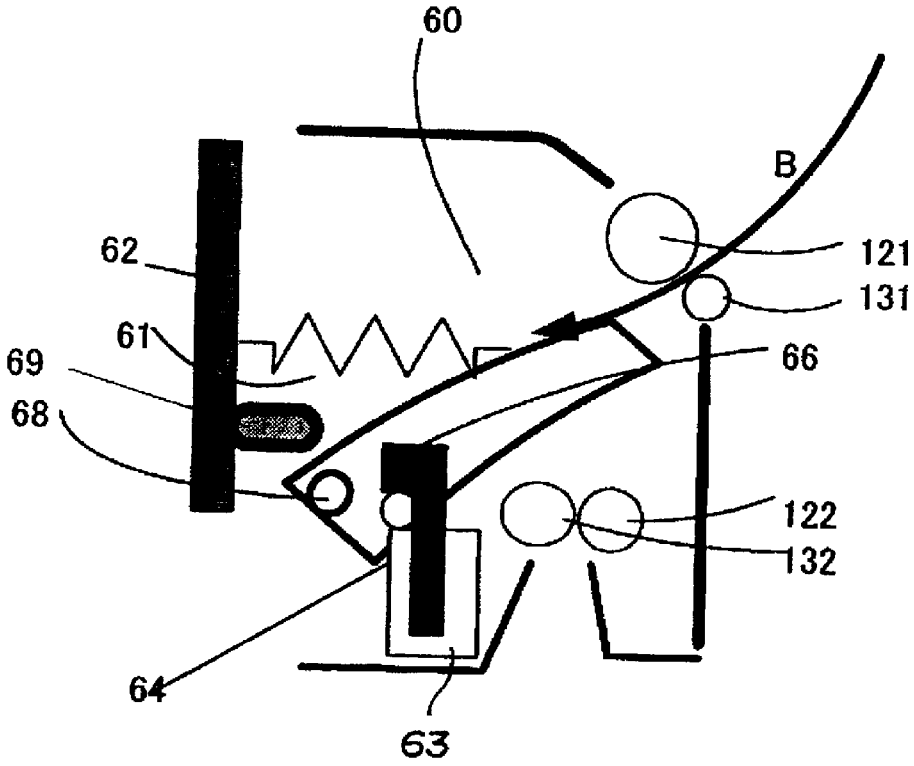
FIG. 5C is a view illustrating a double-sided conveying guide mode according to the second embodiment.

FIG. 5A illustrates the jam recovery mode, FIG. 5B draws the discharge guide mode, and FIG. 5C illustrates the double-sided conveying guide mode.

In the jam recovery mode shown in FIG. 5A, the rear door 62 is opened, and the discharge switching member 60 is also opened in synchronization with the rear door 62. At this time, the rod 64 is located in the region in which the solenoid 63 may drive. In the first embodiment, the rod 64 and the solenoid 63 are disengaged from each other, and to be pulled out to a region in which the solenoid 63 may not drive, in order to open the discharge switching member 60 wide for the jam recovery because the discharge switching member 60 and the rod 64 are always connected with each other.

On the other hand, the discharge switching member 60 and the rod 64 are not always connected with each other in the second embodiment. Therefore, when the rear door 62 is opened wide, the discharge switching member 60 and the solenoid 63 is disengaged from each other, and the discharge switching member 60 may be opened wide, though the rod 64 is not required to be pulled out to the area in which the solenoid 63 may not drive.

When returned to the discharge guide mode shown in FIG. 5B after jam recovery, the rear door 62 is closed to change the state shown in FIG. 5A to that of FIG. 5B. When the rear door 62 is closed, the discharge switching member 60 is closed in synchronization with the rear door 62, and, as shown in FIG. 5B, an engaging projection 66 extending from the discharge switching member 60 is moved to a position at which the discharge switching member 60 engages with the rod 64. When the engaging projection 66 is moved to a position shown in FIG. 5B, the discharge switching member 60 may engage with the rod 64 to operate the discharge switching member 60 by switching between the on-state and the off-state of the solenoid 63.

In the second embodiment, the solenoid 63 is in an off-state to cause the discharge switching member 60 in the discharge guide mode (FIG. 5B), and the solenoid 63 in an on-state causes the rod 64 to be drawn into the solenoid 63 for the double-sided conveying guide mode (FIG. 5C).

An improved jam recovery may also be obtained according to the above-described configuration, because the opening angle of the discharge switching member 60 may be increased at jam recovery by releasing the discharge switching member 60 from restriction by the solenoid 63.

Though the solenoid has been used as an actuator for driving the discharge switching member 60 in the first embodiment, similar advantages may be obtained also by using, for example, a rack which moves vertically by a driving source, instead of the solenoid 63.

Third Embodiment

Subsequently, a apparatus according to a third embodiment will be described referring to FIG. 6. Here, repeated explanations will be eliminated and only a configuration featuring the third embodiment will be described, since a basic configuration of the apparatus according to the third embodiment is the same as those of the above-described embodiments. Members having similar functions to those of the previously described embodiments will be denoted by the same reference numbers as those in the above-described embodiments.

The third embodiment differs from the second embodiment in a point that a rotary arm, or an elastic arm is mounted at the tip of a rod 64. The third embodiment illustrates an example in which an elastically deformable elastic arm (elastic portion) 67 with a hooked shape is provided on the rod 64.

Figure 6A:
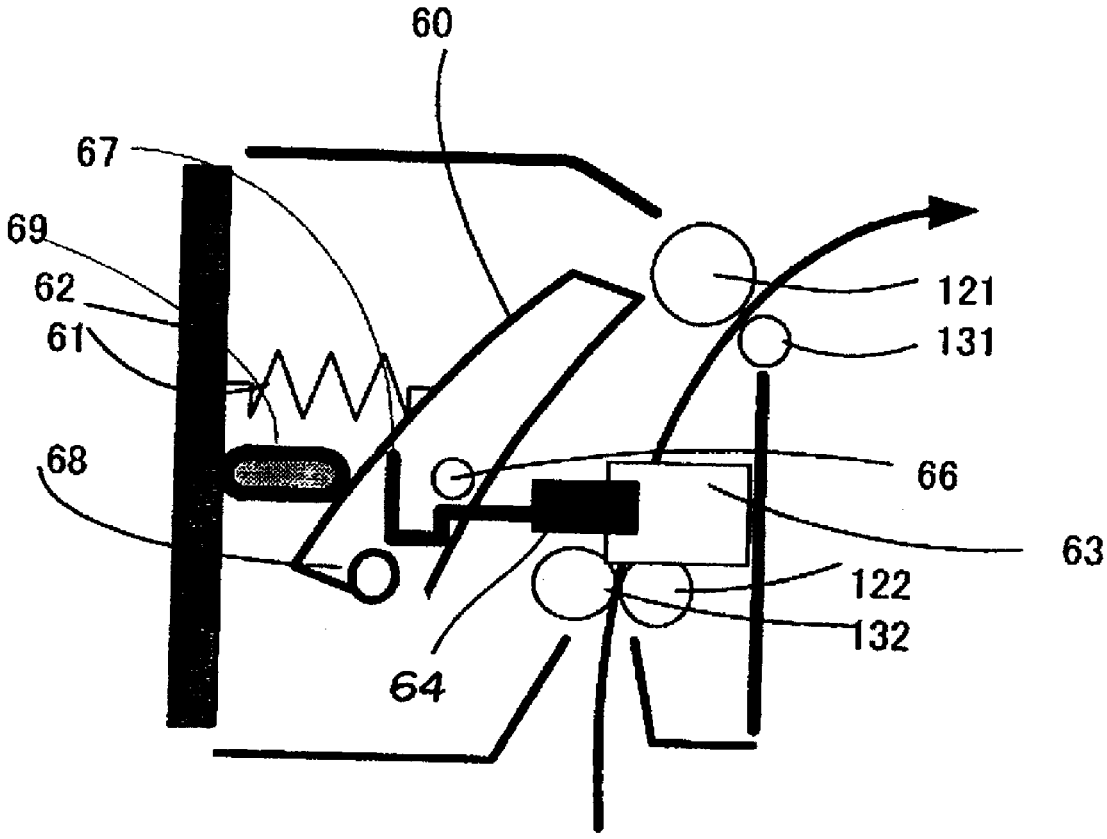
FIG. 6A is a view illustrating a discharge guide mode according to a third embodiment.
Figure 6B:
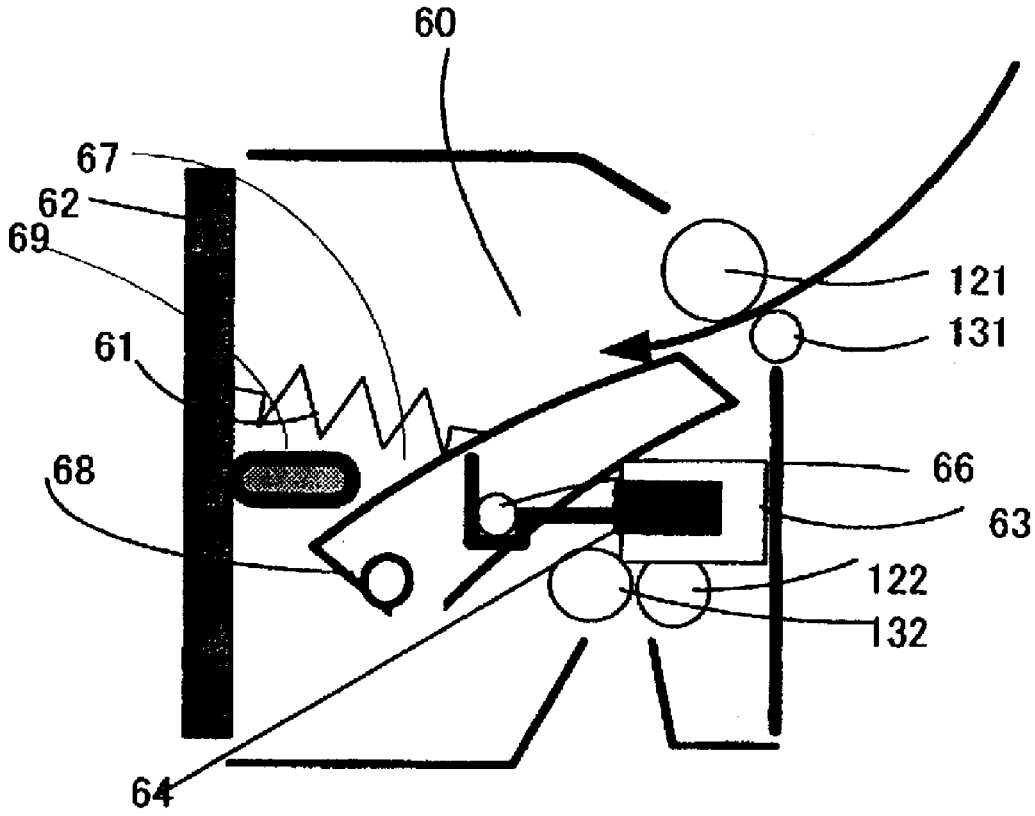
FIG. 6B is a view illustrating a double-sided conveying guide mode according to third embodiment.
Figure 6C:
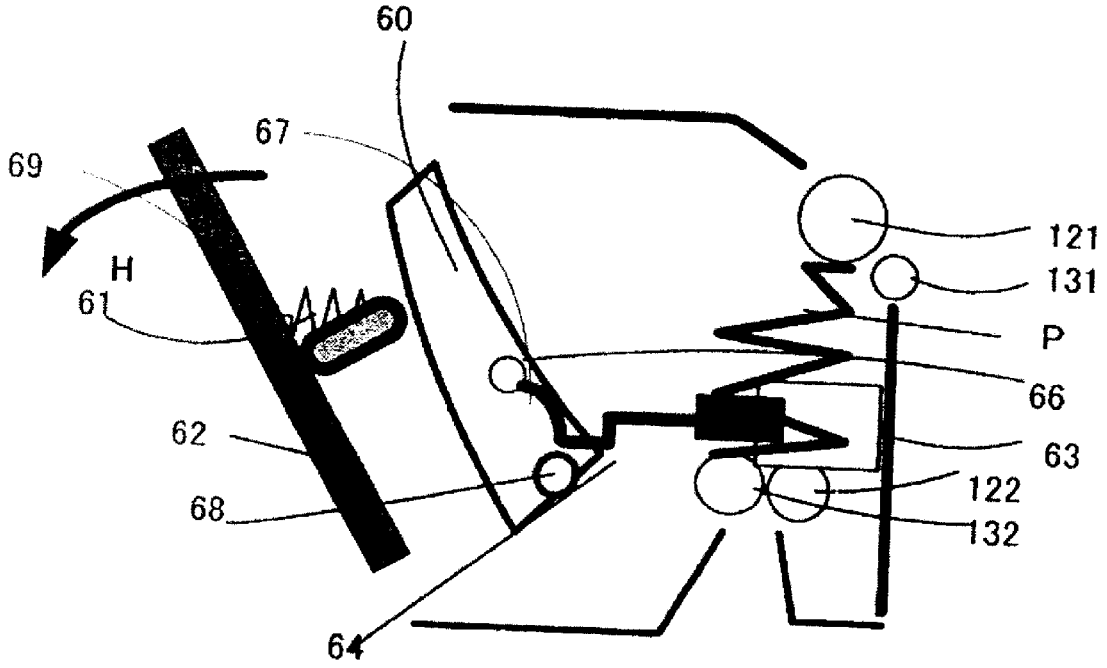
FIG. 6C is a view illustrating a transition process to the jam recovery mode according to the third embodiment.
Figure 6D:
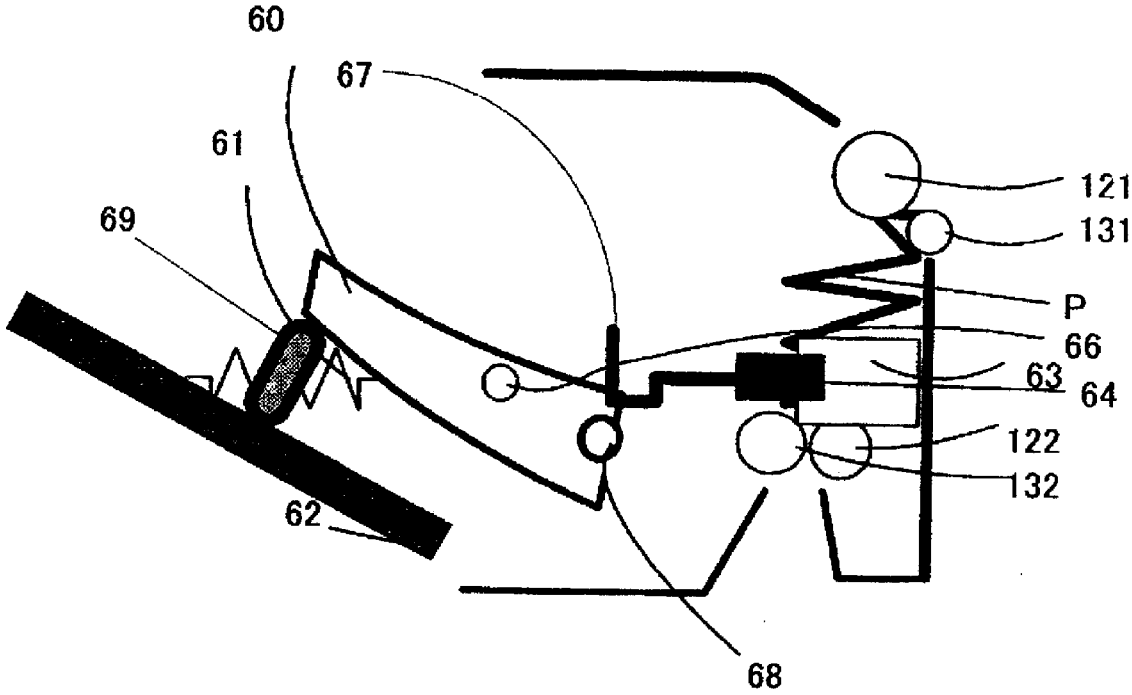
FIG. 6D is a view illustrating the jam recovery mode according to the third embodiment.
Figure 7:
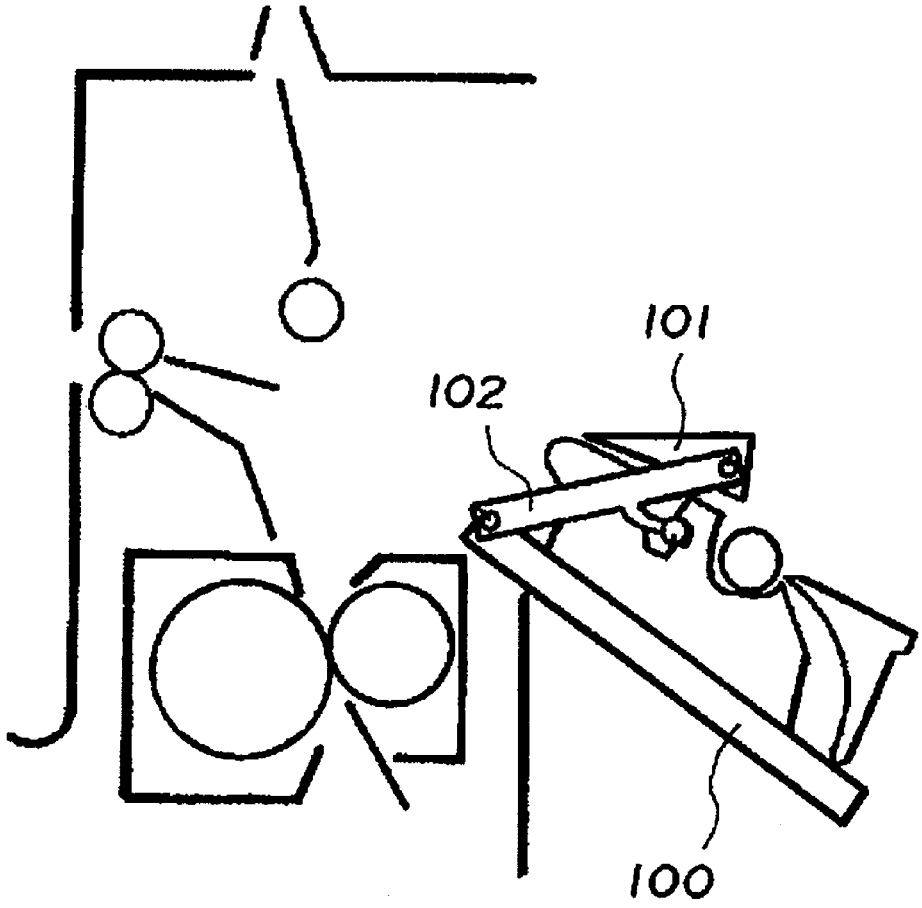
FIG. 7 PRIOR ART
FIG. 7 is a view illustrating a conventional technology.

FIG. 6A illustrates a discharge guide mode of a discharge switching member 60, FIG. 6B draws a double-sided conveying guide mode of the discharge switching member 60, and FIGS. 6C and 6D illustrate a jam recovery mode of the discharge switching member 60.

In the third embodiment in a similar manner to that of the second embodiment, the discharge switching member 60 and the rod 64 are engaged with each other only when a rear door 62 is closed, and the member 60 and the rod 64 are disengaged from each other when the rear door 62 is opened wide. The discharge switching member 60 is moved into a discharge guide mode position or a double-sided conveying guide mode position as shown in FIGS. 6A and 6B, respectively, by switching between the off-state and the on-state of a solenoid 63 when the discharge switching member 60 and the rod 64 is engaged with each other. According to the third embodiment, FIG. 6A shows the off-state of the solenoid 63, and FIG. 6B shows the on-state thereof.

Subsequently, a shift process from the discharge guide mode shown in FIG. 6A to the jam recovery mode shown in FIG. 6D will be described.

Even in the third embodiment, the discharge switching member 60 is opened in synchronization with the rear door 62 in a similar manner to that of the above-described embodiments. As understood from FIG. 6A, an engaging projection 66 of the discharge switching member 60 comes in contact with the elastic arm 67 as a elastic portion formed on the rod 64 when the discharge switching member 60 is rotated in the direction of the arrow H (FIG. 6C) in synchronization with the rear door 62. When the elastic arm 67 receives force by the engaging projection 66 of the discharge switching member 60, the arm 67 deflects as shown in FIG. 6C. When the rear door 62 is further opened, the member 60 is disengaged from the rod 64. Then, as the member 60 is disengaged from the solenoid 63, the discharge switching member 60 may be rotated wide to a position of the jam recovery mode shown in FIG. 6D.

When the jam recovery is completed, and the rear door 62 is closed, the discharge switching member 60 is rotated in the direction opposite to the direction of the arrow H in synchronization with the rear door 62. Then, when the engaging projection 66 of the discharge switching member 60 comes in contact with the elastic arm 67 again, the engaging projection 66 slides into the elastic arm 67 as the elastic arm 67 deflects. Thereby, the discharge switching member 60 and the rod 64 are again engaged with each other. In this state, only the elastic arm 67 deflects, but the rod 64 does not move even when the rod 64 of the solenoid 63 is pushed by the discharge switching member 60. Thereafter, the discharge switching member 60 may be switched into one of the states shown in FIG. 6A and FIG. 6B by switching between the off-state and the on-state of the solenoid 63.

An improved jam recovery may also be obtained according to the above-described configuration, because the opening angle of the discharge switching member 60 may be increased at jam recovery by releasing the discharge switching member 60 from restriction by the solenoid 63.

This application claims the benefit of priority from the prior Japanese Patent Application No. 2006-287385 filed on Oct. 23, 2006 and No. 2007-261463 filed on Oct. 5, 2007, the entire contents of which are incorporated by reference herein.

What is claimed is:

1. A sheet conveying apparatus which can switch a conveying direction of a sheet, comprising:

a main body;

a switching member, provided on the main body, which switches the conveying direction of the sheet;

a cover which is openable and closable to the main body;

a holding member, provided on the cover, which holds the switching member at a first position for guiding the sheet in a first conveying direction;

a biasing member, connecting the switching member and the cover, which applies a force to bias the switching member toward the holding member; and a moving unit which moves the switching member from the first position to a second position for guiding the sheet in a second conveying direction against the force applied by the biasing member, wherein the switching member disengages from the moving unit and moves to a third position by the biasing member when the cover is opened.

2. The sheet conveying apparatus according to claim 1, wherein the moving unit has an actuating member engaging with the switching member, and a driving member actuating the actuating member by engaging with the actuating member, and when the switching member disengages from the moving unit, the actuating member and the driving member disengage from each other.

3. The sheet conveying apparatus according to claim 1, wherein the moving unit has an actuating member engaging with the switching member, and a driving member actuating the actuating member by engaging with the actuating member, and when the switching member disengages from the moving unit, the switching member and the actuating member disengage from each other.

4. The sheet conveying apparatus according to claim 3, wherein the actuating member has an elastically deformable elastic portion, and engages with the switching member through the elastic portion, and when the switching member disengages from the moving unit, the elastic portion is elastically deformed, and disengages from the switching member.

5. The sheet conveying apparatus according to claim 1, wherein when the switching member is moved by more than a predetermined amount, the switching member disengages from the moving unit.

6. The sheet conveying apparatus according to claim 1, wherein the cover opens to allow access to inside of the apparatus.

7. The sheet conveying apparatus according to claim 6, wherein the cover also serves as an exterior of the apparatus.

8. An image forming apparatus that conveys a sheet and forms an image on the sheet, comprising:

an image forming unit which forms the image on the sheet;

a main body which contains the image forming unit;

a switching member, provided on the main body, which switches the conveying direction of the sheet;

a cover which is openable and closable to the main body;

a holding member, provided on the cover, which holds the switching member at a first position for guiding the sheet in a first conveying direction;

a biasing member, connecting the switching member and the cover, which applies a force to bias the switching member toward the holding member; and a moving unit which moves the switching member from the first position to a second position for guiding the sheet in a second conveying direction against the force applied by the biasing member, wherein the switching member disengages from the moving unit and moves to a third position by the biasing member when the cover is opened.

9. The image forming apparatus according to claim 8, wherein the moving unit has an actuating member engaging with the switching member, and a driving member actuating the actuating member by engaging with the actuating member, and when the switching member disengages from the moving unit, the switching member and the actuating member disengage from each other.

10. The image forming apparatus according to claim 8, wherein when the switching member is moved by more than a predetermined amount, the switching member disengages from the moving unit.

11. The image forming apparatus according to claim 8, wherein the cover opens to allow access to inside of the apparatus.

12. The image forming apparatus according to claim 11, wherein the cover also serves as an exterior of the apparatus.

* * * * *